US011085734B1

(12) United States Patent
Balli

(10) Patent No.: US 11,085,734 B1
(45) Date of Patent: Aug. 10, 2021

(54) SIGHT ENHANCER

(71) Applicant: Matthew Balli, Homerville, OH (US)

(72) Inventor: Matthew Balli, Homerville, OH (US)

( * ) Notice: Subject to any disclaimer, the term of this patent is extended or adjusted under 35 U.S.C. 154(b) by 0 days.

(21) Appl. No.: 16/888,246

(22) Filed: May 29, 2020

Related U.S. Application Data

(60) Provisional application No. 62/856,417, filed on Jun. 3, 2019.

(51) Int. Cl.
*F41G 1/02* (2006.01)
*F41G 1/42* (2006.01)

(52) U.S. Cl.
CPC ..... *F41G 1/02* (2013.01); *F41G 1/42* (2013.01)

(58) Field of Classification Search
CPC ..... F41G 1/02; F41G 1/42; F41G 1/04; F41G 1/065
USPC ..... 42/143
See application file for complete search history.

(56) References Cited

U.S. PATENT DOCUMENTS 660,361 A * 10/1900 Candrian ..... F41G 1/04 42/143
1,043,678 A 11/1912 Bertouch
1,162,367 A * 11/1915 Johnson ..... F41G 1/04 42/143
1,329,075 A 1/1920 Fornonzini
1,890,478 A 12/1932 Wale
1,901,399 A 3/1933 Lyman
2,028,055 A 1/1936 Forsling
2,037,422 A 4/1936 Lyman
2,058,305 A 10/1936 Forsling
2,167,012 A 7/1939 Tetzlaff
2,373,984 A * 4/1945 Trask ..... F41G 1/32 42/145
2,486,940 A * 11/1949 Garber ..... F41G 1/04 42/144
2,498,155 A 2/1950 De Jonge
(Continued)

FOREIGN PATENT DOCUMENTS

CA 1073202 A 3/1980
CN 201306975 Y 9/2009
(Continued)

OTHER PUBLICATIONS

Espacenet Bibliographic data:CN201306975(Y), Published Sep. 9, 2009, 1pg.
(Continued)

*Primary Examiner* — John Cooper
(74) *Attorney, Agent, or Firm* — Rankin, Hill & Clark LLP

(57) ABSTRACT

A sight enhancer for an open front sight of a firearm, the sight enhancer having a body wherein the body is selectively securable relative to an open front sight wherein the sight enhancer can be selectively installed and removed from the open front sight to allow for an elevation adjustment of the front sight, the body having a front and a rear wherein the rear faces the rear sight of the firearm, the body further including a sun shade that extends at least partially about a front sight post of the front sight, the sun shade having a top sun shade portion, a first side sun shade portion and a second side sun shade portion that is opposite of the first side shade portion, the sight enhancer further includes one or more securing arrangements for the selective secureability to the open front sight, and a method of using the same.

23 Claims, 13 Drawing Sheets

(56) References Cited

U.S. PATENT DOCUMENTS

| | | | | | |
|---|---|---|---|---|---|
| 2,819,528 | A | * | 1/1958 | Folke | F41G 1/04 42/143 |
| 4,505,047 | A | | 3/1985 | Elbe | |
| 4,686,770 | A | | 8/1987 | Aigner | |
| 4,733,490 | A | | 3/1988 | Mulawski | |
| 4,745,698 | A | | 5/1988 | Schwulst | |
| 4,790,075 | A | | 12/1988 | Howard | |
| 5,519,941 | A | | 5/1996 | Yusko | |
| 8,925,238 | B2 | | 1/2015 | Anderson | |
| 10,101,109 | B2 | | 10/2018 | Caudle | |

FOREIGN PATENT DOCUMENTS

| | | | | | |
|---|---|---|---|---|---|
| DE | 2113592 | A1 | | 9/1972 | |
| DE | 19800688 | C1 | | 7/1999 | |
| ES | 2138876 | A1 | | 1/2000 | |
| GB | 191500788 | A | * | 8/1915 | F41G 1/04 |
| GB | 100551 | A | * | 6/1916 | F41G 1/04 |
| GB | 141296 | A | | 4/1920 | |
| KR | 20130015265 | A | | 2/2013 | |

OTHER PUBLICATIONS

Espacenet Bibliographic data:DE19800688(C1), Published Jul. 22, 1999, 1pg.
Espacenet Bibliographic data:KR20130015265(A), Published Feb. 13, 2013, 1pg.
Espacenet Bibliographic data:ES2138876(A1), Published Jan. 16, 2000, 1pg.

* cited by examiner

SIGHT ENHANCER

This application claims priority in Provisional Patent Application 62/856,417 filed on Jun. 3, 2019, which is incorporated by reference herein.

The invention of this application relates to a sight enhancer for use with firearms. More particularly, to a sight enhancer that can be selectively securable to an existing front sight of a firearm to reduce the effects of sunlight on an open front sight of a rifle to help zero the sight and to maintain the zero over time. The invention of this application has been found to work particularly well with an M-16 style rifle used by police forces and the military wherein this application is describe in relation to this style of rifle, but it is not to be limited thereto.

INCORPORATION BY REFERENCE

The invention of this application relates to U.S. Pat. No. 2,498,155 to De Jonge discloses a Gun Sight and is incorporated by reference for showing the same and forms part of the specification of this application. DE Patent No. 19800688 to Recknagel discloses a Snap On Guard For Front Sight Of Rifle and is incorporated by reference for showing the same and forms part of the specification of this application. U.S. Pat. No. 4,686,770 to Aigner discloses a Mechanical Aiming Device For Rifles and is incorporated by reference for showing the same and forms part of the specification of this application. U.S. Pat. No. 1,043,678 to Bertouch discloses a Foresight For Small-Arms and is incorporated by reference for showing the same and forms part of the specification of this application. U.S. Pat. No. 4,505,047 to Elbe discloses a Front Sight For Small Arms and is incorporated by reference for showing the same and forms part of the specification of this application. U.S. Pat. No. 2,058,305 to Forsling discloses a Front Rifle Sight and is incorporated by reference for showing the same and forms part of the specification of this application. KR Patent No. 20130015265 to Lee discloses a Front Sight Cover Of M16 Rifle and is incorporated by reference for showing the same and forms part of the specification of this application. ES Patent No. 2138876 to Otero De Nulas discloses an Assault Rifle and is incorporated by reference for showing the same and forms part of the specification of this application. U.S. Pat. No. 4,733,490 to Mulawski discloses an Alignment-Impact Indicator For Firearms and is incorporated by reference for showing the same and forms part of the specification of this application. CA Patent No. 1073202 to Zichy discloses a Light Beam Barrel Rigging Sighting System and is incorporated by reference for showing the same and forms part of the specification of this application. U.S. Pat. No. 2,167,012 to Tetzlaff discloses a Front Sight For Firearms and is incorporated by reference for showing the same and forms part of the specification of this application. U.S. Pat. No. 8,925,238 to Anderson discloses a Firearm Sight and is incorporated by reference for showing the same and forms part of the specification of this application. U.S. Pat. No. 4,745,698 to Schwulst discloses Weapon Sights and is incorporated by reference for showing the same and forms part of the specification of this application. U.S. Pat. No. 4,790,075 to Howard discloses a Portable Removable Gun Sight and is incorporated by reference for showing the same and forms part of the specification of this application. U.S. Pat. No. 2,373,984 to Trask discloses a Gun Sight and is incorporated by reference for showing the same and forms part of the specification of this application. GB Patent No. 141296 to Earle Fontonore Watson discloses Sights For Fire-Arms and is incorporated by reference for showing the same and forms part of the specification of this application. U.S. Pat. No. 5,519,941 to Yusko discloses a Sight For Firearms and is incorporated by reference for showing the same and forms part of the specification of this application. U.S. Pat. No. 2,028,055 to Forsling discloses a Full View Rifle Front Sight and is incorporated by reference for showing the same and forms part of the specification of this application. DE Patent No. 2113592 to Huebner discloses a Firearms Vising Facility and is incorporated by reference for showing the same and forms part of the specification of this application. CN Patent No. 201306975 to Liu discloses a Notch Type Sight Aiming Device and is incorporated by reference for showing the same and forms part of the specification of this application. U.S. Pat. No. 1,329,075 to Fornonzini discloses a Sighting Means For Firearms, Optical Apparatus, And The Like and is incorporated by reference for showing the same and forms part of the specification of this application. U.S. Pat. No. 1,890,478 to Wale discloses a Gun Sight and is incorporated by reference for showing the same and forms part of the specification of this application. U.S. Pat. No. 1,901,399 to Lyman discloses a Sight and is incorporated by reference for showing the same and forms part of the specification of this application. U.S. Pat. No. 2,037,422 to Lyman discloses a Gun Sight and is incorporated by reference for showing the same and forms part of the specification of this application. U.S. Pat. No. 10,101,109 to Caudle discloses a Submachine Gun Conversion Unit and is incorporated by reference for showing the same and forms part of the specification of this application.

BACKGROUND OF THE INVENTION

The inventor of this application enlisted in the United States Army Reserve in 1989 as a military police officer. It was at Fort McClellan in Alabama when the issue with zeroing and firing the M-16 rifle at targets was first learned. The problem related to the effect that sun had on the front sights. The drill sergeants at the time attempted to "fix" this problem by the use of a black magic marker on the front sight post. However, it was discovered that this did not fix the problem in that the problem relates to the disappearance of parts of the front sight post due to direct light, such as direct sunlight, which causes "sunlight distortion" on the front sight.

In 1992, the inventor became a full time police officer with the city of East Cleveland. Towards the end of 1993, he earned a spot on the East Cleveland SWAT unit and was pegged as a sniper and started to attend schools as a Sniper. During this time, the problems zeroing and then maintaining zero with the M-16/AR-15 platforms as well as other rifle platforms remained. Again, the "fix" for this was to dab black magic marker on the front sight posts or smoke them. Both of these methods helped deal with sunlight, but it did not do away completely with the issue and they do not eliminate sunlight distortion.

As the inventor's career as a law enforcement officer progressed, he was given additional duties wherein the inventor then became a firearms instructor. In this position, he assisted others with shooting and ultimately took over the firearms qualification responsibility for his agency. Over the next few years, the inventor attended semi-auto handgun, revolver, shotgun, select-fire assault rifle, carbine, sub-machinegun, and scope sighted rifle instructor courses. He eventually took over all firearms training for the police department and he continued to compete in shooting tournaments. In the early 2000's he became a guest instructor for courses at the Ohio Peace Officer Training Academy in London Ohio. He was there assisting with assault rifle courses, sub-machinegun, sniper school and just about anything that fired a bullet. He eventually received trainer of trainer status wherein he became certified to teach the trainers who teach the weapon systems to others. The inventor held this status for over fifteen years.

Along with helping to teach courses for the state and running all of the firearms training for his agency, the inventor began to attend armorer courses for a vast number of military and police weapon systems such as Smith and Wesson, Colt, Glock, Heckler & Koch, Berretta, Remington, and Benelli. At this point, the inventor was not only one of the better shooters around; he also knew how the weapons really worked and was able to diagnose issues pertaining to them. Having gained knowledge and experience from a shooting career that spans over thirty years, almost twenty-five years of teaching the weapons to police officers, soldiers, and civilians, fifteen or more years of training others to be trainers, continuing to take shooting courses to learn the next best thing, the inventor still never came upon or across a solution to "fix" one issue that causes some big problems. The issue being sunlight distortion on an open front sight of military and police style weapons.

In greater detail, when the sunlight hits directly on the front sight post, it causes sunlight distortion. Sunlight distortion is where the light from the sun makes portions of the sight disappear. As a result, only parts of the front sight are visible to the eye, which causes a misalignment of the sight relative to the target. If this misalignment were consistent, adjustments could be made and zeroing could be maintained. However, sunlight distortion is dependent on "sun angle" and "sun intensity" wherein, it constantly changes throughout the day and even changes based on the level of cloud cover. In greater detail, the portions of the sight that are directly engaged by sunlight will shine brightly and the remaining portions are in shadow. The portions that shine brightly from the sun disappear from view (non-visible portions) and the portions in shadow are visible (visible portions) wherein the eye only sees the visible portions. The sunlight distortion on the front sight draws the eye to only the visible portions of the sight wherein only the visible portions of the sight are used to center the sight on the target. When less than all of the front sight is "visible," this cause sight misalignment. Again, adjustment can be made to address the sight misalignment, but changes in the sun's angle relative to the firearm and/or changes to the sun's intensity due to cloud cover will change the sunlight distortion wherein zeroing cannot be maintained throughout the day. For example, if direct sunlight is from the right side of the sight, the sunlight distortion will make a right side portion of the sight post disappear (non-visible portion) wherein only a left side portion of the sight post will be a visible portion. This causes only the left side portion of the sight to be centered on the target resulting in a wide right shot. If the sun distortion also causes a portion of the top of the sight post to disappear, the sunlight distortion will also cause a vertical misalignment wherein the shot will be too high. It has been found that sunlight distortion can cause a combination of the sides and/or top of the sight to disappear, which prevents the maintaining of the zeroing of the firearm throughout the day based on the angle and/or intensity of the sun. As a result, it has been found that shooters of an open sight weapon, like police and military M-16 rifles, throughout the day begin to miss targets to the left, right, and even sometimes overshoot the targets. The misses have been found to be the result of sunlight distortion and are less significant, or non-existent, on overcast days. Yet even further, the sunlight distortion will change based on the aiming direction of the weapon in that changing the direction in which the firearm is aimed will change the sun angle relative to the front sight.

Shooters instinctively center what they perceive as the front sight post on their target. The problem is that when it is not the entire sight post, due to sunlight distortion, the shot will be misaligned. At closer ranges, sunlight distortion is less significant, but it still exists. However, as the target gets farther out, or smaller, the misses begin to get very large. So a shooter who is shooting right of the target because the sunlight is coming in from the right side will adjust their sight to move the point of impact to the left. That's great if the sun would stay still and no clouds come into play. If a cloud shows up and blocks the sunlight the shooter will now shoot left of where they intended because the entire sight will be visible.

Unfortunately, the sun moves throughout the day. As the sun moves, so does its impact on the front sight. If sunlight is coming from above, the shooter does not see the top of the front sight post or there is a glare on it so bad that they adjust and end up shooting high. As the sun moves, so does the point of impact. The only way to stop this is to take the sun out of the equation.

SUMMARY OF THE INVENTION

The invention of this application relates to a sight enhancer and, more particularly, to a sight enhancer that takes the sun out of the equation by preventing sunlight distortion on the front sight.

More particularly, the sight enhancer of this application takes the sun out of the equation by blocking it from reaching at least some portions of the front sight to prevent sunlight distortion.

Even more particularly, the sight enhancer of this application includes at least one sun shade that prevents sunlight distortion to take the sun out of the equation.

The sight enhancer according to another aspect of the invention of this application is selectively securable to the front sight wherein it can be installed and removed from the weapon with ease. This is important because the front sights of military and police weapons are used to make the elevation adjustments for the sighting of the weapon. All of these are adjusted from the top, which is why the front sight posts are all open. Having a sight enhancer that is selectively securable allows it to be removed for adjustments and then re-installed without significant effort and/or time.

The sight enhancer according to other aspects of the invention of this application is permanently affixed to the weapon wherein this can be done without changing any mechanics of the firearm.

In further detail, the sight enhancer of this application is placed on the front sight apparatus and prevents sunlight distortion in the open front sight so that the shooter can fire a group of rounds at a target unaffected by sunlight. The shooter then checks the target, determines any needed adjustments, removes the sight enhancer from the front sight, makes the adjustments to the front sight, then places the sight enhancer back on the sight and fires another group. This process is repeated until the weapon is zeroed with a true front sight post un-affected by light.

Yet even further, it was found that the sight enhancer does more than just take the sun out of the equation. The sight enhancer also makes target acquisition quicker wherein, it allows the shooter to both grab and center targets in the sights a lot quicker. The sight enhancer of this application makes all of the open fields above and to the sides of the front sight post disappear.

According to yet another aspect of the invention, the sight enhancer can include a round sight opening, which also helps acquire targets faster because all that is needed is to center the target in the circle at the end of the barrel.

Upon testing the invention of this application, it was confirmed that shooters were able to see the front sight post clearer and were able to acquire targets faster. This equates to more accuracy faster, which equals higher and faster hit rates. This equates to a higher chance of survival for our police and military personnel.

These and other objects, aspects, features and advantages of the invention will become apparent to those skilled in the art upon a reading of the Detailed Description of the invention set forth below taken together with the drawings which will be described in the next section.

BRIEF DESCRIPTION OF THE DRAWINGS

The invention may take physical form in certain parts and arrangement of parts, a preferred embodiment of which will be described in detail and illustrated in the accompanying drawings which form a part hereof and wherein.

DESCRIPTION OF PREFERRED EMBODIMENTS

Figure 1:
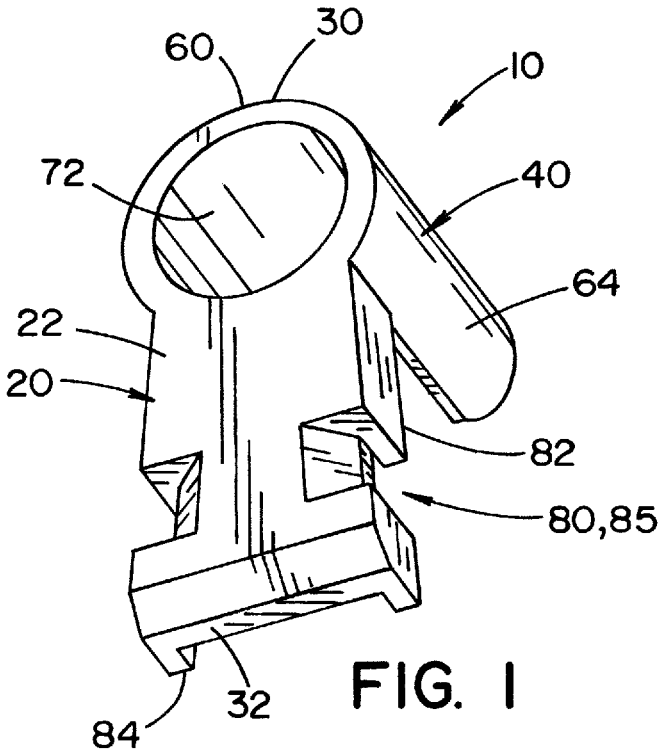
FIG. 1 is a front perspective view of a sight enhancer according to a first embodiment of the invention of this application.
Figure 2:
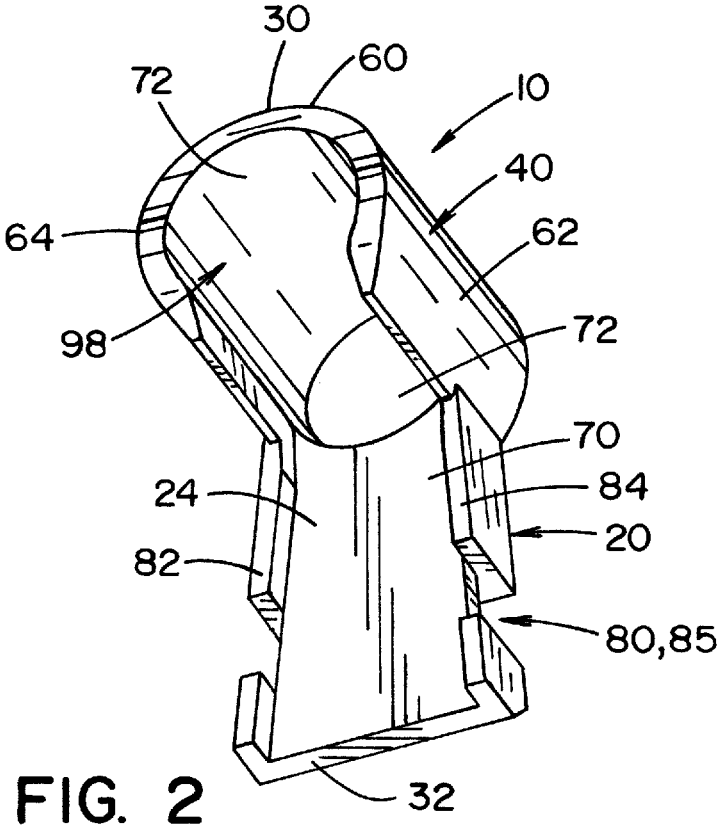
FIG. 2 is a rear perspective view of the sight enhancer shown in FIG. 1.
Figure 4:
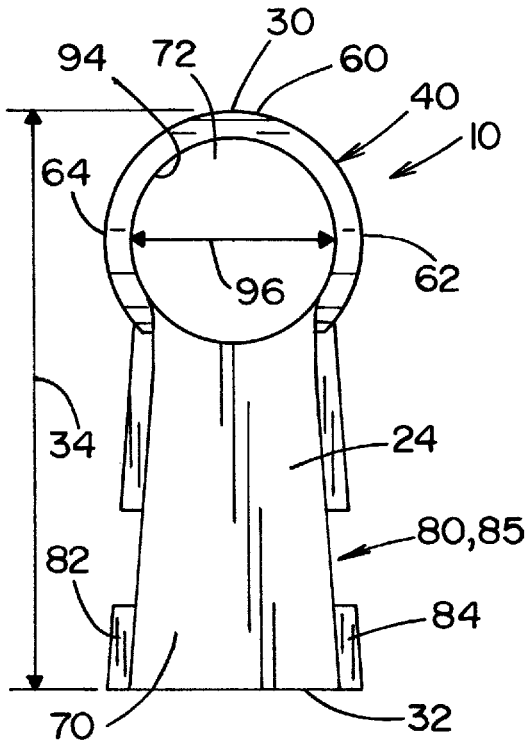
FIG. 4 is a rear elevational view of the sight enhancer shown in FIG. 1.
Figure 3:
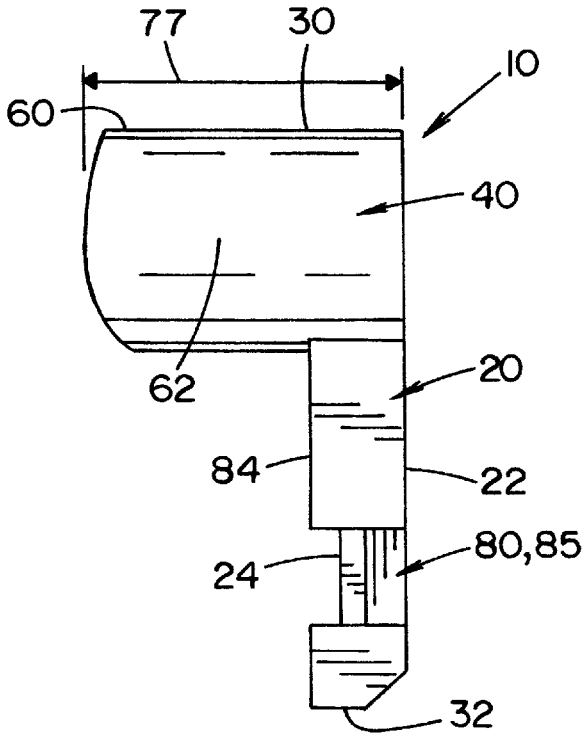
FIG. 3 is a right-side elevational view of the sight enhancer shown in FIG. 1.

Referring now to the drawings wherein the showings are for the purpose of illustrating preferred and alternative embodiments of the invention only and not for the purpose of limiting the same, FIGS. 1-7 show a first set of embodiments of a sight enhancer 10 according to certain aspects of the present invention. Sight enhancer 10 can be selectively securable to a front sight 12 of a firearm 14. In other embodiments, it can be "permanently" affixed to the firearm without mechanical changes to the firearm. As is noted above, while the invention of this application is primarily directed toward military and police applications wherein the showings are directed to military and police firearms, the invention of this application can be used on any open sight wherein it is not to be limited to the examples shown. Moreover, the disclosure of this application includes certain dimensional details; however, these are also directed to the version shown only wherein this disclosure is not intended to limit the invention of this application.

In greater detail, sight enhancer 10 is selectively securable to front sight 12. Accordingly, sight enhancer 10 can be installed and removed from the weapon 14 with ease. This is important because the front sights of many military and police weapons are used to make the elevation adjustments for the sighting of the weapon. All of these weapons are adjusted from the top, which is why the front sight posts are typically open. As will be discussed in greater detail below, when sight enhancer 10 is attached to front sight 12, it shields the front post from sunlight thereby preventing sunlight distortion. The method of sighting firearm 14 includes the following steps.

1—Sight enhancer 10 is secured to front sight 12;

2—A first group of rounds is then fired at a target and this step is completed without the effect of sunlight distortion produced by portions of the front sight post being too bright to see which again will be discussed more below.

3—The target is checked for the group of rounds that were fired;

4—A determination is made concerning the necessary adjustment needed for the front sight;

5—Sight enhancer 10 is removed from the front sight;

6—The needed adjustments are made to front sight 12;

7—Sight enhancer 10 is re-secured to front sight 12; and,

8—A second group of rounds is then fired at the target and this step is again completed without the effect of sunlight distortion.

This process is repeated until the weapon is zeroed with a true front sight post un-affected by light distortion. This process also applies to other embodiments of the sight enhancer of this application.

Figure 26:
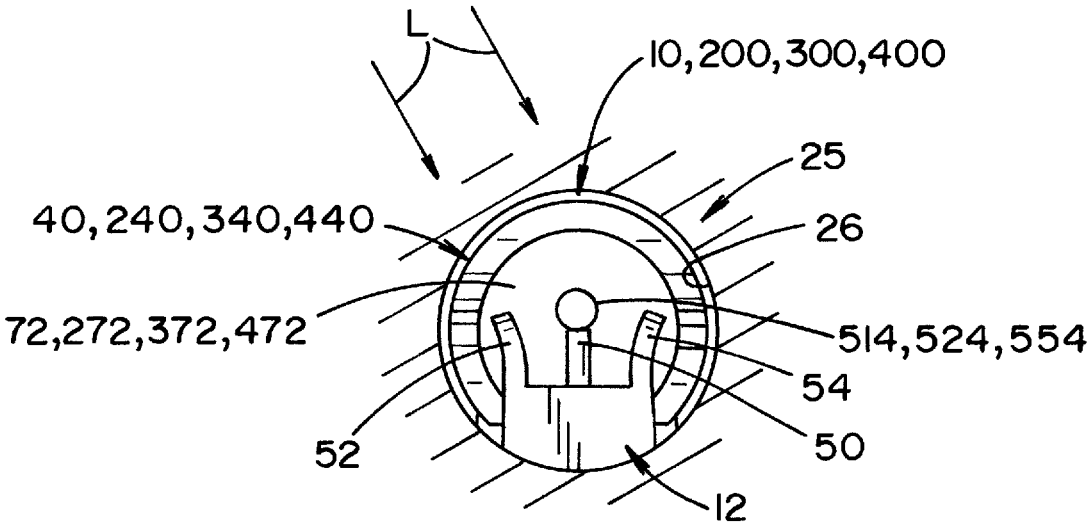

Sight enhancer 10 has body 20 with a front 22 and a rear 24 wherein rear 24 faces a rear sight 25 shown in FIG. 26 having a rear sight opening 26. Sight enhancer 10 further includes a top 30 and a bottom 32 wherein the bottom faces firearm 14. In particular, the bottom faces the barrel of the firearm in the example shown. Sight enhancer 10 has an overall height 34 between top 30 and bottom 32. Height 34 can be based on the front sight dimension and can vary without detracting from the invention of this application. In one set of embodiments, height 34 is greater than 1.0 inches. In another set of embodiments, height 34 is greater than 1.25 inches. In yet another set of embodiments, height 34 is greater than 1.5 inches. In even yet another set of embodiments, height 34 is between 1.5 inches and 2.25 inches. In yet another set of embodiments, height 34 is between 1.5 inches and 2.0 inches.

Sight enhancer 10 further includes one or more sun shades 40 that block light, such as sunlight, from shining on the front sight post 50, which will be discussed in greater detail below. In the embodiment shown in these figures, sun shade 40 includes a top sun shade portion 60, a first side sun shade portion 62 and a second side sun shade portion 64. In this set of embodiments, sight enhancer 10 has a curved configuration wherein top sun shade 60 and/or at least some portions of side shades 62 and 64 are curved. Moreover, as is shown in this embodiment and others, top sun shade portion 60, first side sun shade portion 62 and/or second side sun shade portion 64 can be a unified and continuous structure and can be an extension of a unified body component. However, other shapes and/or configurations could be utilized without detracting from the invention of this application. Sight enhancer 10 can further include a vertically extending panel 70 that can include an enhancer opening 72. In the embodiment shown, vertically extending panel 70 is a front panel.

Sun shade 40 can extend from vertical panel 70. In this embodiment, sun shade 40 extends rearward from front panel 70. Moreover, some or all of top sun shade portion 60, first side sun shade portion 62 and second side sun shade portion 64 can extend rearwardly from vertical panel 70. In this set of embodiments and others, sun shade has an extension extent 77 that can further enhance the sun blocking effect of the sight enhancer. In one set of embodiments, extension extent 77 is greater than 0.5 inches. In another set of embodiments, extension extent 77 is greater than 0.75 inches. In yet another set of embodiments, extension extent 77 is between 0.75 inches and 1.25 inches. In even yet another set of embodiments, extension extent 77 is about 0.95 inches. This extension extent dimension can equally relate to other embodiments of this application including those noted below.

Sight enhancer 10 further includes one or more securing arrangements 78 that are configured to selectively secure the sight enhancer relative to the front sight. The securing arrangement 78 can include a wide range of configurations to fix enhancer 10 relative to the front sight and/or align the sight enhancer relative to the front sight. The securing arrangements can include, but are not limited to, one or more tie openings 80 and opposing barbs or flanges 82 and 84. As is shown, the openings can be any form of opening including one or more slots. Moreover, the flanges of securing arrangements can both help secure and align sight enhancer 10 relative to the front sight and can include other forms of barbs, flanges and/or rearwardly extending walls. Yet even further, flanges 82 and 84 can be one or more flanges wherein in the embodiment shown in these figures, they include a slot 85 that forms part of the one or more opening 80. In this respect, the securing arrangement of the sight enhancer can further include one or more securing straps 86, such as wire ties, to secure sight enhancer 10 relative to front sight 12. In this embodiment, openings 80 are shaped to receive securing strap(s) 86 wherein the strap(s) can extend about sight enhancer 10 and about the front sight to secure the enhancer relative to the front sight. Securing arrangement 78 can further include one or more magnets, which will be shown in described in greater detail below. In that many police and military front sights are iron sights, magnets can help selectively secure sight enhancer 10 relative to the front sight. As will also be discussed more below, there can be two magnets and two magnet pockets, but this is not required. Any combination of these securing arrangements could be used without detracting from the invention of this application. Moreover, other securing arrangements could be used.

Sight enhancer 10 can further include one or more enhancing rings 92, which can outline opening 72 and further help target acquisition when the firearm is used. Enhancing ring 92 can utilize different colors to improve the performance of the sight enhancer. The colors can include, but are not limited to red, orange, yellow, white, blue and green. As can be appreciated, the colors can be bright eye-catching colors to aid in target acquisition. Yet further, the enhancing rings can utilize other "eye-catching" features including, but not limited to, fiber optic technologies to further improve target acquisition. In one set of embodiments, enhancing ring itself can be a transparent ring that acts like fiber optic technology wherein the entire ring will gather light and "glow." This can include, but is not limited to, a ring made out of an acrylic material. Yet even further, the enhancing rings of this application can be a separate ring structure that is selectively securable. Accordingly, the enhancing rings of different colors and/or different levels of transparency can be selectively secured to the sight enhancer without detracting from the invention of this application. According to one set of embodiments, this can allow the different ring technologies to be used without significantly affecting the size and/or diameter of the enhancer opening. While not shown, other types of fiber optic technology could be utilized in the sight enhancer of this application. This can include, but is not limited to, fiber optics aligned relative to the front sight post, which are spaced from ring 92. This can also include one or more fiber optic inserts within the sight enhancer.

Yet further, the opening 72 has an inward opening shape 94. As is shown, shape 94 is circular having an inner diameter 96 that can be based on the size of the sights and/or the desired performance of the sighting system. In one set of embodiments, inner diameter 96 is greater than 0.4 inches. In another set of embodiments, inner diameter 96 is greater than 0.5 inches. In yet another set of embodiments, inner diameter 96 is between 0.45 inches and 0.7 inches. In yet even another set of embodiments, inner diameter 96 is about 0.60 inches. As with other feature discussed with reference to this set of embodiments, inner diameter 96 can equally relate to other embodiments of this application including those noted below.

Figure 5:
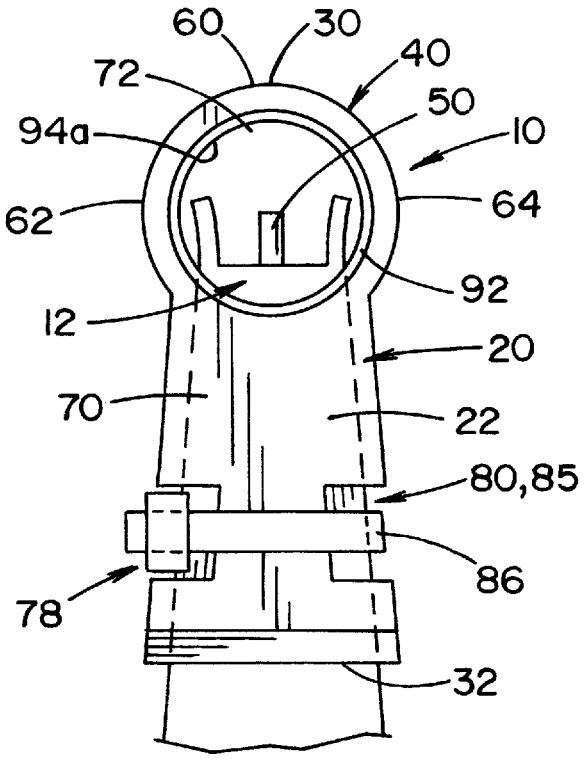
FIG. 5 is a front elevational view of the sight enhancer shown in FIG. 1 shown in a mounted condition on a front sight of a rifle.
Figure 6:
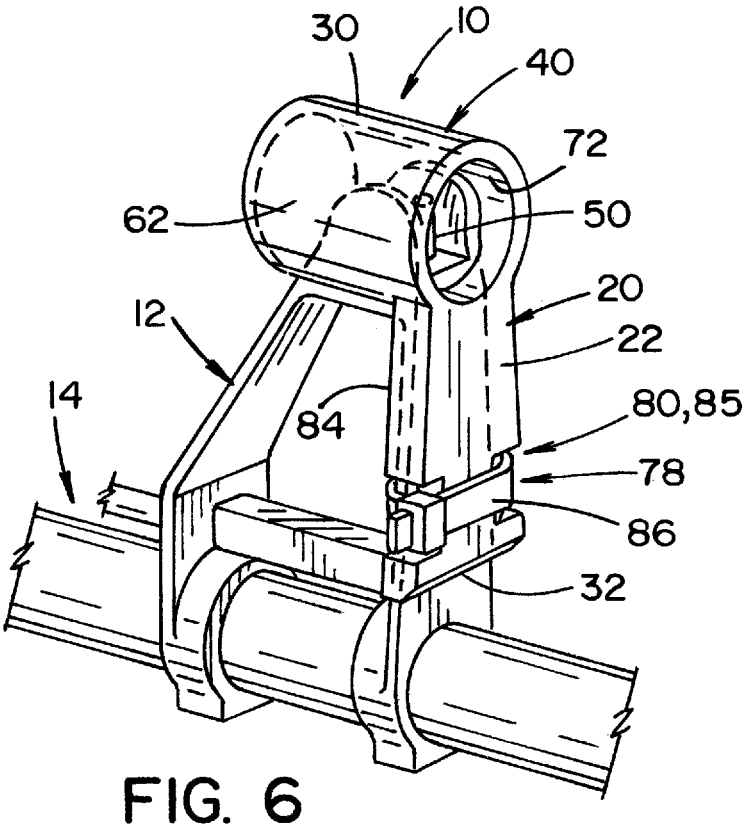
FIG. 6 is a front-side perspective view of the sight enhancer shown in FIG. 1 shown in a mounted condition on a front sight of a rifle.
Figure 7:
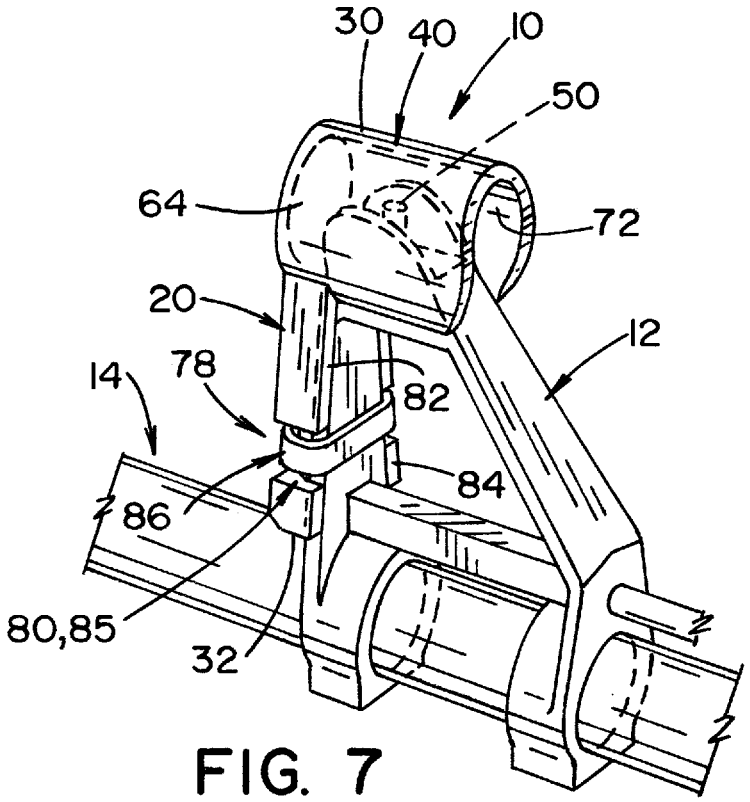
FIG. 7 is a rear-side perspective view of the sight enhancer shown in FIG. 6 mounted to the front sight of a rifle.
Figure 8:
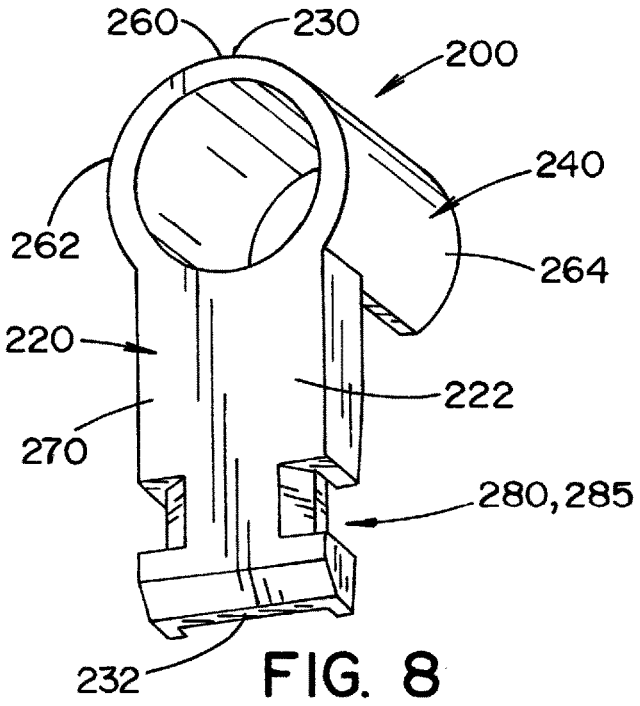
FIG. 8 is a front perspective view of a sight enhancer according to other aspects of the invention of this application.
Figure 9:
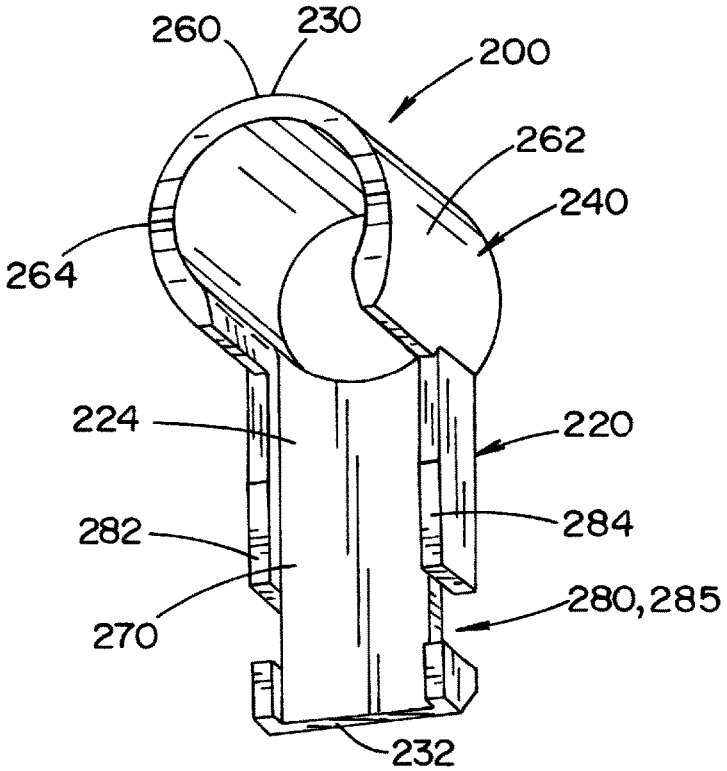
FIG. 9 is a rear perspective view of the sight enhancer shown in FIG. 8.
Figure 11:
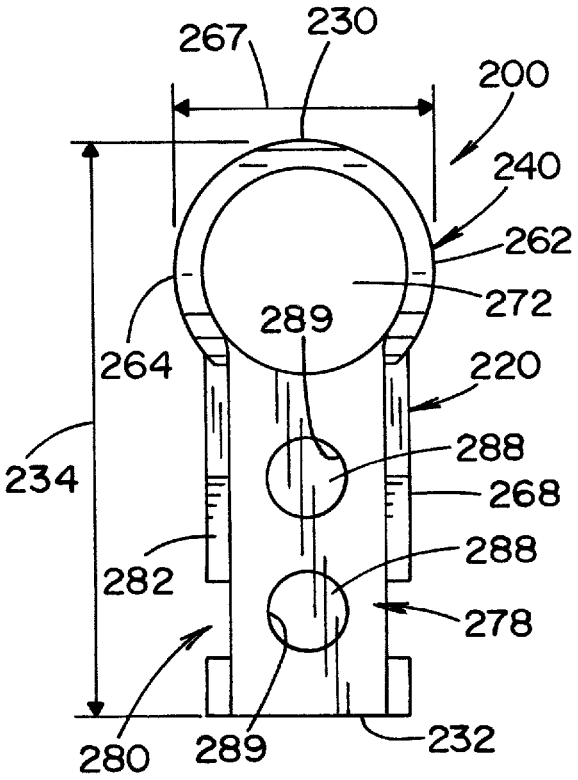
FIG. 11 is a rear elevational view of the sight enhancer shown in FIG. 8.
Figure 10:
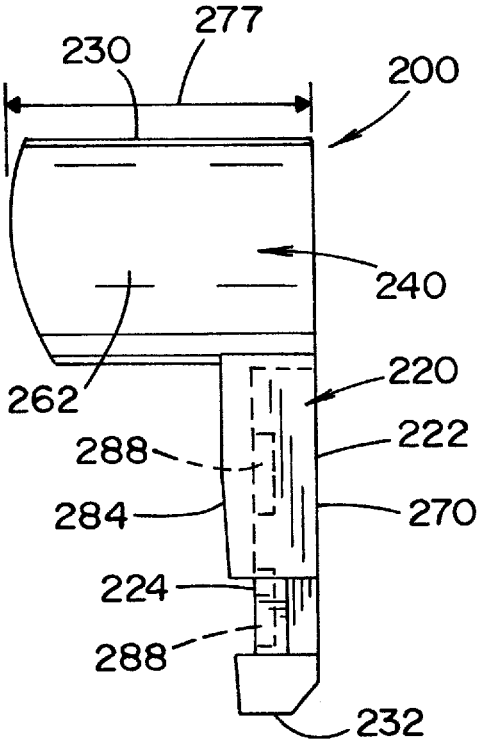
FIG. 10 is a right-side elevational view taken from FIG. 8.
Figure 12:
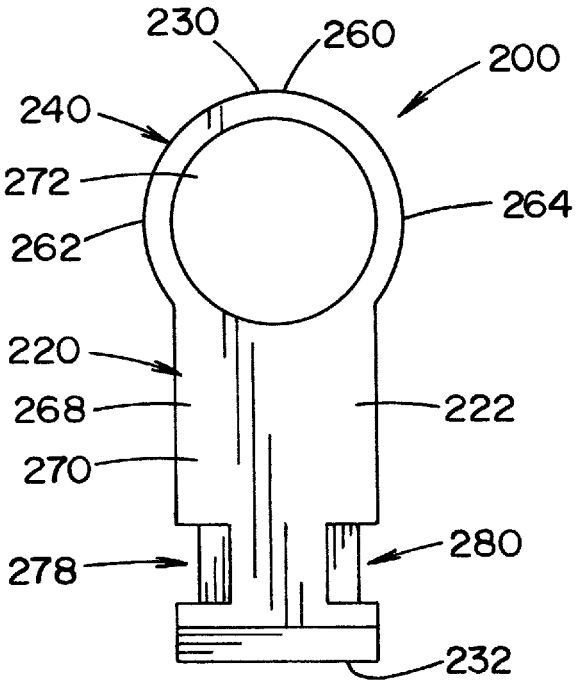
FIG. 12 is a front elevational view of the sight enhancer shown in FIG. 8.
Figure 13:
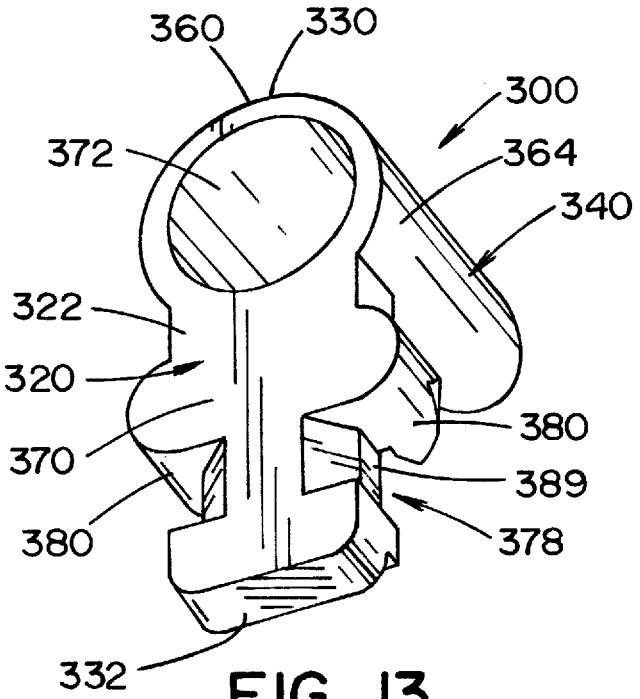
FIG. 13 is a front perspective view of a sight enhancer according to yet other aspects of the invention of this application.
Figure 14:
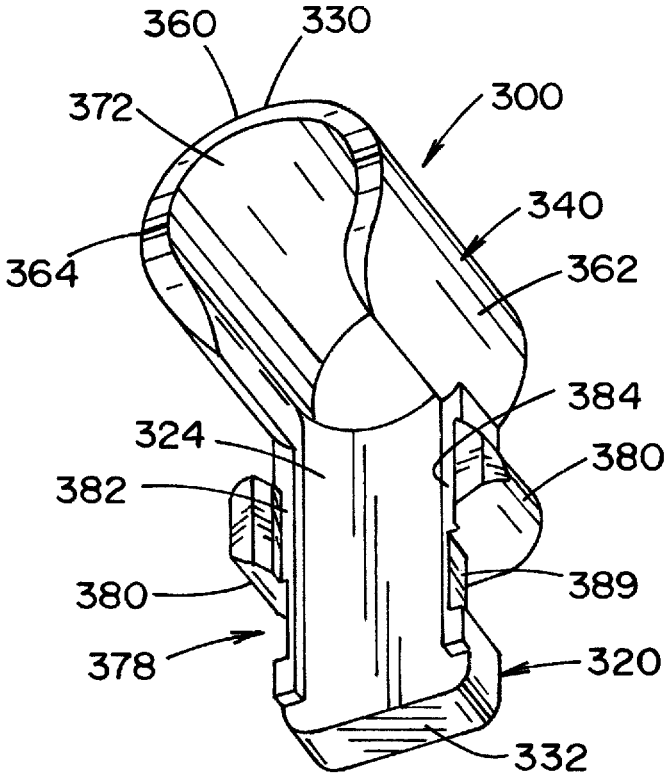
FIG. 14 is a rear perspective view of the sight enhancer shown in FIG. 13.
Figure 16:
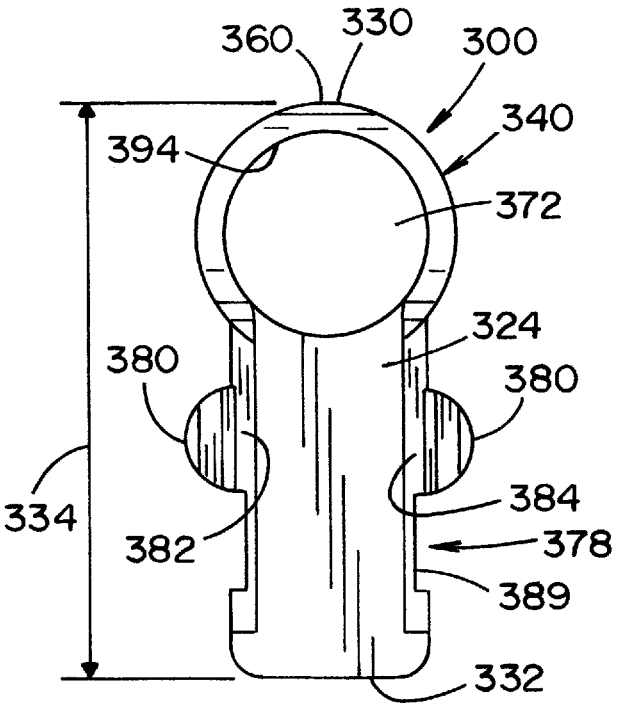
FIG. 16 is a rear elevational view of the sight enhancer shown in FIG. 13.
Figure 15:
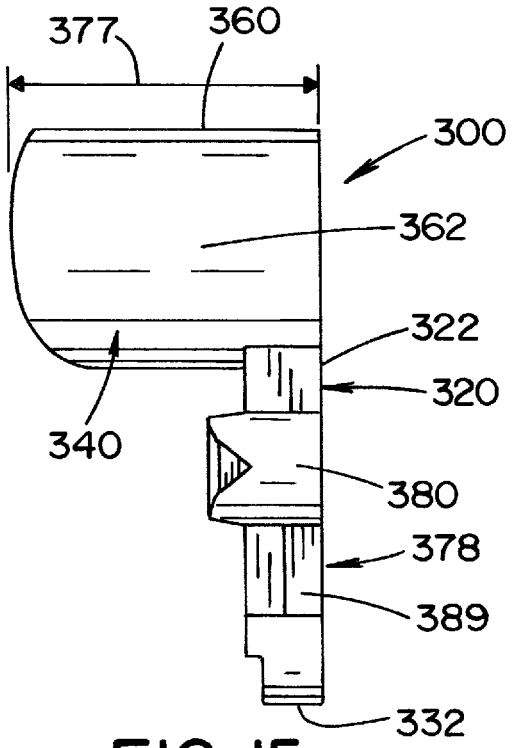
FIG. 15 is a right-side elevational view of the sight enhancer shown in FIG. 13.
Figure 17:
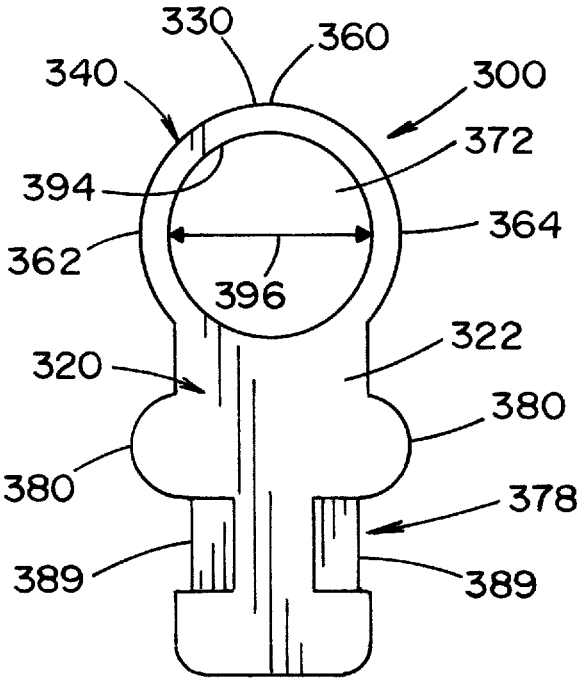
FIG. 17 is a front elevational view of the sight enhancer shown in FIG. 13.
Figure 18:
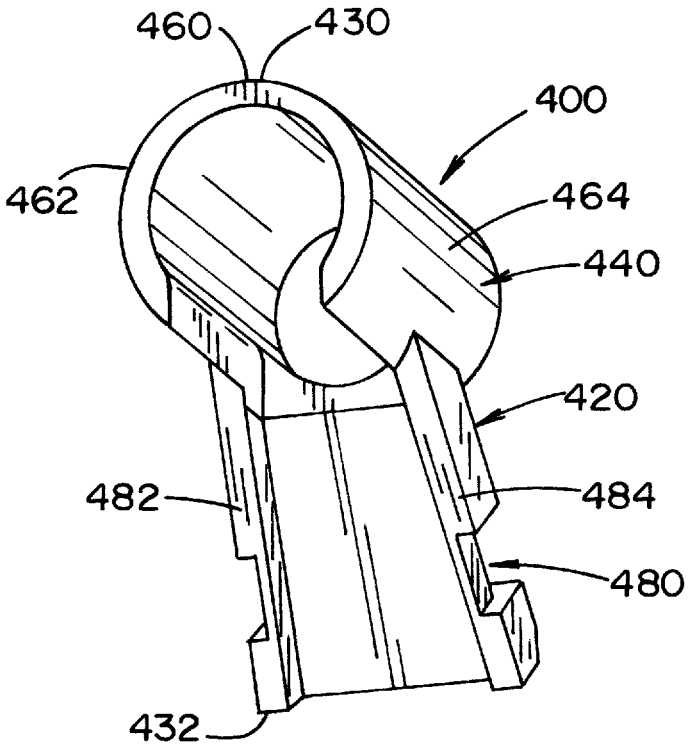
FIG. 18 is a front perspective view of a sight enhancer according to yet other aspects of the invention of this application.
Figure 19:
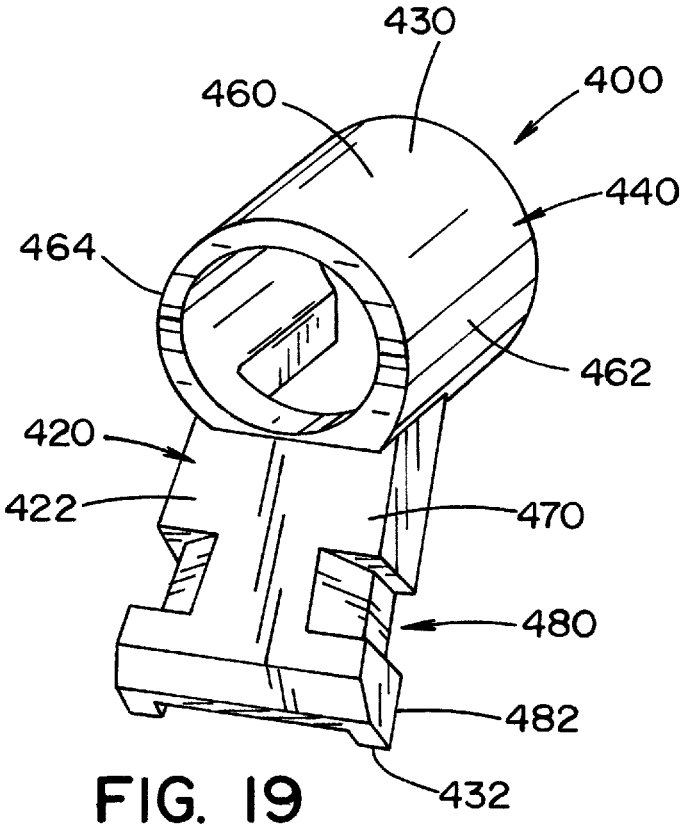
FIG. 19 is a rear perspective view of the sight enhancer shown in FIG. 18.
Figure 21:
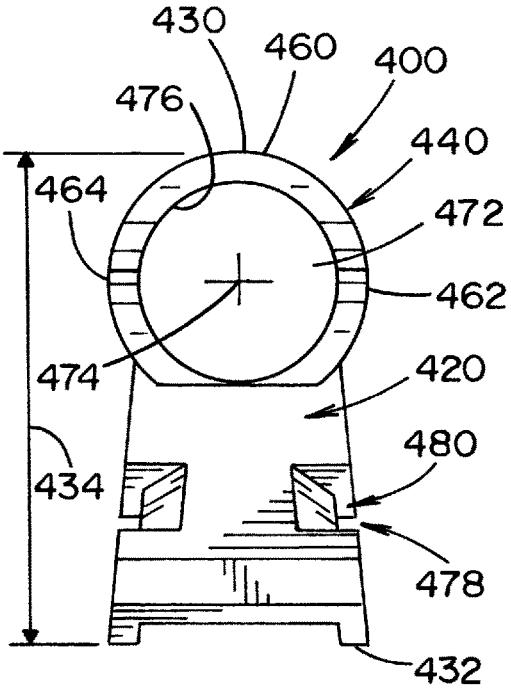
FIG. 21 is a rear elevational view of the sight enhancer shown in FIG. 18.
Figure 20:
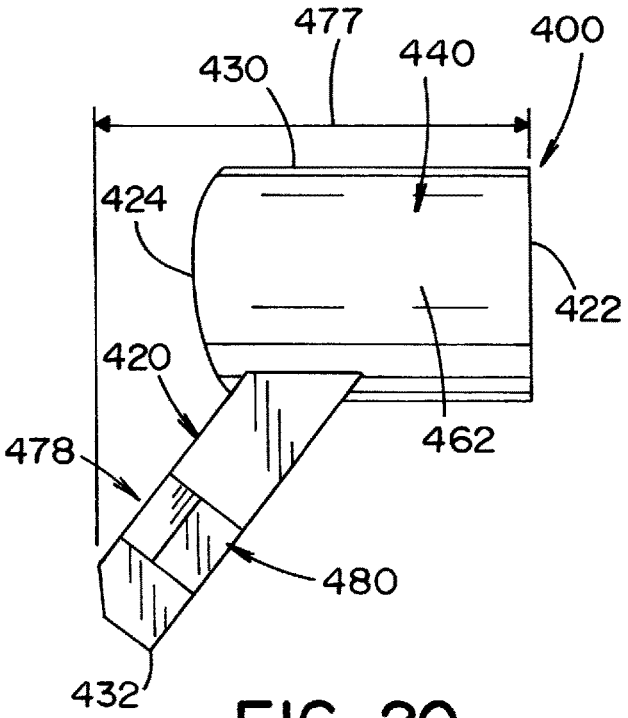
FIG. 20 is a right-side elevational view of the sight enhancer shown in FIG. 18.
Figure 22:
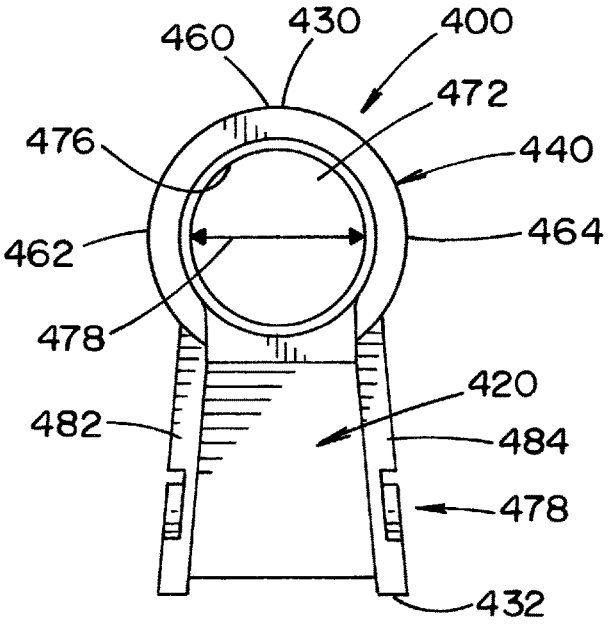
FIG. 22 is a front elevational view of the sight enhancer shown in FIG. 18.

Similarly, enhancing ring(s) 92 can have a specific ring inner opening shape 94*a* that can be the same as shape 94 discussed above including the inner ring diameter of ring 92 being that same as diameter 96 discussed above. Moreover, rings 92 can have different configurations from one another including rings 92 that have different inner opening diameters. Yet further, enhancing rings 92 can also be selectively securable relative to body 20 wherein enhancing rings 92 can be changed for multiple reasons that can include, but are not limited to, changes to the color, changes to optic technology and/or changes to the inner opening diameter. Similarly top sun shade portion 60, first side sun shade portion 62 and second side sun shade portion 64 of sun shade 40 can be a unified structure having an inner sun shade shape 98. This inner sun shade shape can be similar in shape and size as inward opening shape 94. Moreover, inward sun shade shape 98 can be circular having an inner sun shape diameter that can be based on the size of the inner enhancer opening diameter 96. The inward sun shade shape also can be coaxial with the inner enhancer opening thereby extending the length of the opening. FIGS. 5-7 show how sight enhancer is fixed relative to front sight 12.

FIGS. 8-12 show yet another set of embodiments of the invention of this application. These figures show a sight enhancer 200.

Sight enhancer 200 has a body 220 and includes a front 222 and a rear 224 wherein rear 224 faces a rear sight (not shown). Sight enhancer 200 further includes a top 230 and a bottom 232 wherein bottom 232 faces firearm 14. In particular, the bottom faces the barrel of the firearm. Sight enhancer 200 has an overall height 234 between top 230 and bottom 232. Height 234 can be based on the front sight dimension and can vary without detracting from the invention of this application. In one set of embodiments, height 234 is greater than 1.0 inches. In another set of embodiments, height 234 is greater than 1.25 inches. In yet another set of embodiments, height 234 is greater than 1.5 inches. In even yet another set of embodiments, height 234 is between 1.5 inches and 2.25 inches. In yet another set of embodiments, height 234 is between 1.5 inches and 2.0 inches.

Sight enhancer 200 further includes one or more sun shades 240 that block light, such as sunlight, from shining on the front sight post 50 and/or side blades 52 and 54 (see FIGS. 5-7), which will be discussed in greater detail below. In the embodiment shown in these figures, sun shade 240 that is the widest part of body 220. Sun shade 240 includes a top sun shade 260, a right side sun shade portion 262 and a left side sun shade portion 264. In this set of embodiments, sight enhancer 200 also has a curved sun shade configuration, but wherein it has a width 267 that is greater than a lower body portion 268. Moreover, lower body portion 268 has parallel sides. Again, this shows that the invention of this application can have a wide range of configurations without detracting from the invention of this application.

As noted above, sun shade 240 that is the widest part of body 220 wherein it has a width 267 that is wider than lower body portion 268. Width 267 is measured from the left and right extents of the right and left side sections of sun shade 240. Width 267 also can be based on the front sight dimension and can vary without detracting from the invention of this application. In one set of embodiments, width 267 is greater than 0.50 inches. In another set of embodiments, width 267 is greater than 0.65 inches. In yet another set of embodiments, width 267 is between 0.65 inches and 1.0 inches. In yet another set of embodiments, width 267 is between 0.70 inches and 0.85 inches.

Sight enhancer 200 can further include a vertically extending front panel 270 that can include an enhancer opening 272, which are discussed above in greater detail.

Sun shade 240 can extend from vertical panel 270. In this embodiment, sun shade 240 extends rearward from front panel 270. Moreover, some or all of top sun shade portion 260, first side sun shade portion 262 and second side sun shade portion 264 can extend rearwardly from vertical panel 270. In this set of embodiments and others, sun shade has an extension extent 277 that can further enhance the sun blocking effect of the sight enhancer. In one set of embodiments, extension extent 277 is greater than 0.5 inches. In another set of embodiments, extension extent 277 is greater than 0.75 inches. In yet another set of embodiments, extension extent 277 is between 0.75 inches and 1.25 inches. In even yet another set of embodiments, extension extent 277 is about 0.95 inches. This extension extent dimension can equally relate to other embodiments of this application including those noted below. As will be discussed more below, the sun shade can extend on both sides of the vertical panel without detracting from the invention of this application in this embodiment and the others too.

Sight enhancer 200 further includes one or more securing arrangements 278 that can selectively secure the sight enhancer relative to the front sight. The securing arrangement 278 can include a wide range of configurations to fix enhancer 200 relative to the front sight and/or align the sight enhancer relative to the front sight. The securing arrangements can include, but are not limited to, openings 280 and opposing flanges 282 and 284. Again, the openings can be any form of opening including one or more slots. In addition, the flanges of securing arrangements can both help secure and align sight enhancer 200 relative to the front sight and can include other forms of flanges and/or rearwardly extending walls. Flanges 282 and 284 can also include slots 285 that form part of the one or more opening 280. The securing arrangement of the sight enhancer can further include one or more securing straps, which was discussed above in greater detail.

Again, securing arrangement 278 can include one or more magnets 288 that can be secured within magnet pockets 289. Again, since many police and military front sights are iron sights, magnets can help selectively secure sight enhancer 10 relative to the front sight. As is shown in this set of embodiments, there can be two magnets 288 and two magnet pockets 289, but this is not required. Again, any combination of these securing arrangements could be used without detracting from the invention of this application. Moreover, other securing arrangements could be used.

Sight enhancer 200 can further include one or more enhancing rings as discussed above that can outline opening 272 and further help target acquisition when the firearm is used.

FIGS. 13-17 show yet other sets of embodiments of the sight enhancer according to yet other aspects of the invention of this application. These figures show a more streamlined version of the device that has more of a "lollypop" configuration. In greater detail, shown is a sight enhancer 300 having an enhancer body 320. In this set of embodiments, sight enhancer is more concealed behind front sight 12 wherein they provide the greater amount of viewing range around the front sight for even yet better target acquisition.

Sight enhancer 300 has a front 322 and a rear 324 wherein rear 324 faces a rear sight (not shown). Sight enhancer 300 further includes a top 330 and a bottom 332 wherein the bottom faces firearm 14. In particular, the bottom faces the barrel of the firearm in the example shown. Sight enhancer 300 has an overall height 334 between top 330 and bottom 332. Height 334 can be based on the front sight dimension and can vary without detracting from the invention of this application. In one set of embodiments, height 334 is greater than 0.9 inches. In another set of embodiments, height 334 is greater than 1.20 inches. In yet another set of embodiments, height 334 is greater than 1.30 inches. In even yet another set of embodiments, height 334 is between 1.30 inches and 1.80 inches. In yet another set of embodiments, height 334 is between 1.35 inches and 1.75 inches.

Sight enhancer 300 further includes one or more sun shades 340 that blocks light, such as sunlight, from shining on the front sight post 50, which will be discussed in greater detail below. In the embodiments shown in these figures, sun shade 340 includes a top sun shade portion 360, a first side sun shade portion 362 and a second side sun shade portion 364. In this set of embodiments, sight enhancer 300 also has a curved configuration wherein top sun shade 360 and/or at least some portions of side shades 362 and 364 are curved. In addition, the sight enhancer of this set of embodiments includes sun shade 340 that has a circular configuration wherein the sun shade can be a generally unified structure and can be coaxial with an enhancer opening 372. Sight enhancer 300 can further include a vertically extending front panel 370 that includes enhancer opening 372.

Opening 372 has an inward opening shape 394. As is shown, shape 394 is circular having an inner diameter 396 that can be based on the size of the sights and/or the desired performance of the sighting system. In one set of embodiments, inner diameter 396 is greater than 0.4 inches. In another set of embodiments, inner diameter 396 is greater than 0.5 inches. In yet another set of embodiments, inner diameter 396 is between 0.45 inches and 0.7 inches. In yet even another set of embodiments, inner diameter 396 is about 0.60 inches. As with other feature discussed with reference to this set of embodiments, inner diameter 396 can equally relate to other embodiments of this application including those noted below.

Sun shade 340 can extend from vertical panel 370. In this embodiment, sun shade 340 extends rearward from front panel 370. Moreover, some or all of top sun shade portion 360, first side sun shade portion 362 and second side sun shade portion 364 can extend rearwardly from vertical panel 370. In this set of embodiments and others, sun shade has an extension extent 377 that can further enhance the sun blocking effect of the sight enhancer. In one set of embodiments, extension extent 377 is greater than 0.5 inches. In another set of embodiments, extension extent 377 is greater than 0.75 inches. In yet another set of embodiments, extension extent 377 is between 0.75 inches and 1.25 inches. In even yet another set of embodiments, extension extent 377 is about 0.95 inches. This extension extent dimension can equally relate to other embodiments of this application including those noted below. As will be discussed more below, the sun shade can extend on both sides of the vertical panel without detracting from the invention of this application in this embodiment and the others too.

Sight enhancer 300 further includes one or more securing arrangements 378 that are configured to selectively secure the sight enhancer relative to the front sight. In the embodiments shown in these figures, securing arrangement 378 can include includes one or more clips 380 that can include opposing barbs 382 and 384. Clips 380 can be a part of the enhancer body itself or can be one or more separate clips that attached relative to the sight enhancer and that are selectively securable to the front sight (not shown). In the embodiments shown, sight enhancer 300 can include a pair of strap slots or openings 389. Sight enhancer can further include one or more securing straps, such as wire ties, to secure sight enhancer 300 relative to front sight 12. Securing arrangement 378 can further include one or more magnets that can be positioned within magnet pockets. In that many police and military front sights are iron sights, magnets can help selectively secure sight enhancer 300 relative to the front sight. Any combination of these securing arrangements could be used without detracting from the invention of this application. Moreover, other securing arrangements could be used.

Moreover, the securing arrangements of this application can include different levels of securing the sight enhancer relative to the front sight for all embodiments. This can include a first level wherein the sight enhancer is held relative to the front sight for zeroing only. This first level is used to zero the sight and allows the sight enhancer to be easily removed and repositioned on the front sight. For example, the first level can be the use of the magnets in the magnet pockets that will have sufficient holding power to allow the firearm to be zeroed. The securing arrangement can then include a second level that can more "permanently" secure the sight enhancer to the front sight. The second level can be used to fire the weapon during police or military activities. This second level of attachment can include the use of straps to make sure that the sight enhancer remains fixed relative to the front sight, clips or the like. But, again, these are examples only wherein the first and second levels can utilize a wide range of attachment arrangements. Moreover, while the use of straps can be used to "permanently" secure the sight enhancer to the front sight, the sight enhancer is still selectively removable so that it can be removed each time the sight needs to be adjusted.

Again, securing arrangement can further include alignment features or elements. In this set of embodiments, clips 380 can be utilized to help align the sight enhancer relative to the front sight wherein proper alignment of these components is achieved. Sight enhancer 300 can further include side flanges 388 and 389 that can both help secure the sight enhancer relative to the front sight and/or help align the sight enhancer relative to the front sight. This can be more important for sun shades that are configured in relation to the enhancer opening, such as sun shades that are coaxial to the enhancer opening. Again, this can include utilizing the clips, or other arrangements, that prevent a lower portion of the sight enhancer from moving left or right. It can also prevent the sight enhancer from moving forwardly or rearwardly relative to the front sight. Again, different levels of attachments are associated with the attachment arrangement including alignment control wherein clips can be mounting and/or alignment clips.

Sight enhancer 300 can further include one or more enhancing rings, which are discussed in greater detail above. As is noted above, these rings can partially and/or fully outline opening 372 and further help target acquisition when the firearm is used. Again, enhancing ring(s) can utilize different colors to improve the performance of the sight enhancer. As can be appreciated, and as is referenced above, the colors can be bright eye-catching colors to aid in target acquisition. Yet further, the enhancing rings can utilize other "eye-catching" features including, but not limited to, fiber optic technologies to further improve target acquisition. Moreover, other types of fiber optic technology could be utilized in the sight enhancer of this application. This can include, but is not limited to, fiber optics aligned relative to the front sight post, which are spaced from the ring(s). This can also include one or more fiber optic inserts within the sight enhancer and/or fixed relative to the front sight post.

FIGS. 18-22 show yet other sets of embodiments of the sight enhancer according to yet other aspects of the invention of this application. These embodiments show a rear mount sight enhancer 400. Sight enhancer 400 has an enhancer body 420, but much of the body is behind the front sight instead in front of the front sight.

Sight enhancer 400 has a front 422 and a rear 424 wherein rear 424 faces a rear sight (not shown). Sight enhancer 400 further includes a top 430 and a bottom 432 wherein the bottom faces firearm 14. Sight enhancer 400 has an overall height 434 between top 430 and bottom 432. Height 434 can be based on the front sight dimension and can vary without detracting from the invention of this application. In one set of embodiments, height 434 is greater than 1.0 inches. In another set of embodiments, height 434 is greater than 1.25 inches. In yet another set of embodiments, height 434 is greater than 1.50 inches. In even yet another set of embodiments, height 434 is between 1.5 inches and 2.25 inches. In yet another set of embodiments, height 434 is between 1.50 inches and 2.0 inches.

Sight enhancer 400 further includes one or more sun shades 440 that blocks light, such as sunlight, from shining on the front sight post 50. Sun shade 440 includes a top sun shade portion 460, a first side sun shade portion 462 and a second side sun shade portion 464. In this set of embodiments, sight enhancer 400 also has a curved configuration wherein top sun shade 460 and/or at least some portions of side shades 462 and 464 are curved. In addition, the sight enhancer of this set of embodiments includes sun shade 440 that has a circular configuration wherein the sun shade can be a generally unified structure and can be coaxial with an enhancer opening 472.

While sight enhancer 400 includes a vertically extending panel 470, panel 470 is a rear panel and not a front panel. Moreover, vertically extending rear panel 470 extends upwardly at an angle. Accordingly, while sight enhancer includes an enhancer opening 472, an opening axis 474 of enhancer opening 472 is not perpendicular with panel 470. Moreover, as is shown in this embodiment, the sun shade can extend beyond the vertically extending panel of the sight enhancer on both sides of the vertical panel.

Opening 472 has an inward opening shape 476. As is shown, shape 476 is circular having an inner diameter 478 that can be based on the size of the sights and/or the desired performance of the sighting system. In one set of embodiments, inner diameter 476 is greater than 0.4 inches. In another set of embodiments, inner diameter 476 is greater than 0.5 inches. In yet another set of embodiments, inner diameter 476 is between 0.45 inches and 0.7 inches. In yet even another set of embodiments, inner diameter 476 is about 0.60 inches. As with other feature discussed with reference to this set of embodiments, inner diameter 476 can equally relate to other embodiments of this application including those noted below.

Sun shade 440 can extend from vertical panel 470. In this embodiment, sun shade 440 extends both forwardly and rearward from front panel 470. Moreover, some or all of top sun shade portion 460, first side sun shade portion 462 and/or second side sun shade portion 464 can extend both forwardly and rearwardly from vertical panel 470. In this set of embodiments and others, sun shade has an extension extent 477 that can further enhance the sun blocking effect of the sight enhancer. In that extension extent in this embodiment extends both forwardly and rearwardly of panel 470, it can be longer than other embodiments. In one set of embodiments, extension extent 477 is greater than 0.5 inches. In another set of embodiments, extension extent 477 is greater than 0.85 inches. In yet another set of embodiments, extension extent 477 is between 0.85 inches and 1.35 inches. In even yet another set of embodiments, extension extent 477 is about 1.05 inches. This extension extent dimension and/or configuration can equally relate to other embodiments of this application including those noted above.

As with the other sight enhancers, sight enhancer 400 further includes one or more securing arrangements 478 that are configured to selectively secure the sight enhancer relative to the front sight. However, in this set of embodiments, sight enhancer 400 is secured relative to a back side of the front sight. Securing arrangement 478 can include includes one or more slots 480 and opposing forwardly extending flanges 482 and 484 wherein slots 480 can extend through the flanges. Sight enhancer 400 can further include one or more securing straps, such as wire ties, to secure sight enhancer 400 relative to front sight 12. Securing arrangement 478 can further include one or more magnets. Any combination of these securing arrangements could be used without detracting from the invention of this application. Moreover, other securing arrangements could be used. Again, this can also include the noted different levels of securing the sight enhancer relative to the front sight. As with the other embodiments, this embodiment can also include a securing arrangement that has alignment features, such as flanges 482 and 484. Sight enhancer 400 can further include one or more enhancing rings as are discussed above in greater detail.

Figure 23:
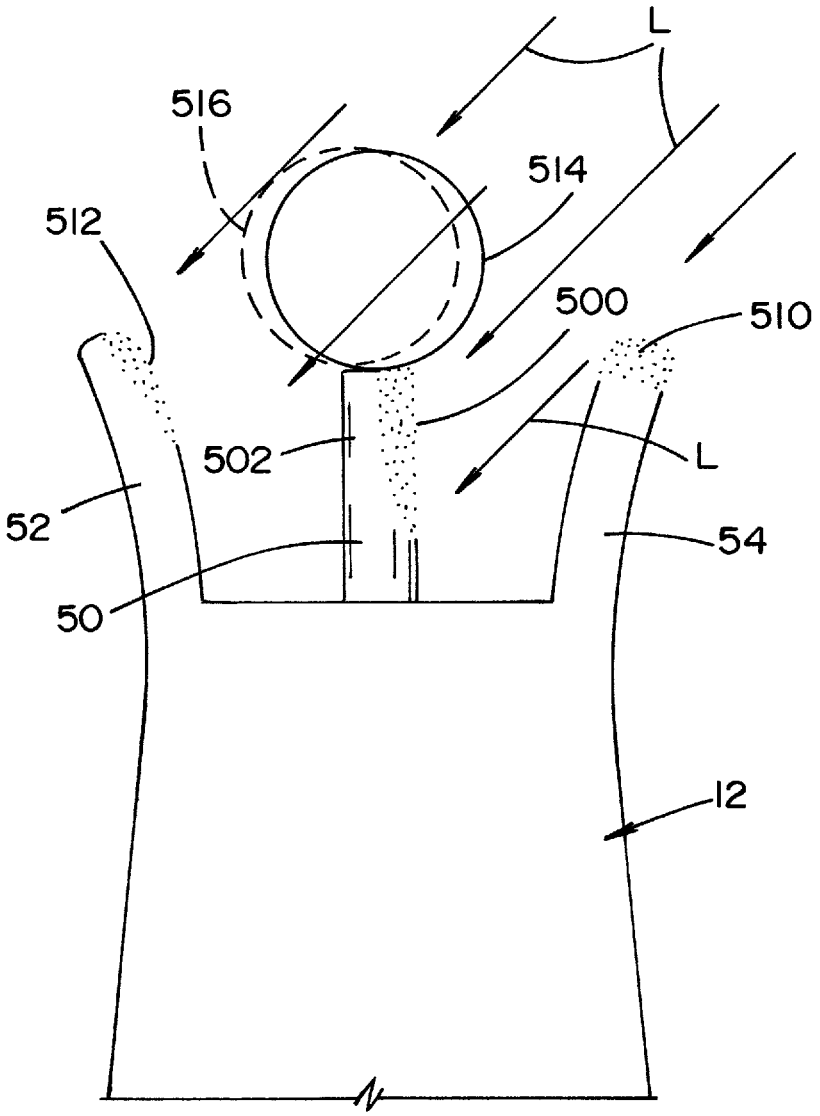
FIG. 23 is a schematic view of an open front sight with sun exposure oriented on the right side of the front sight.
Figure 24:
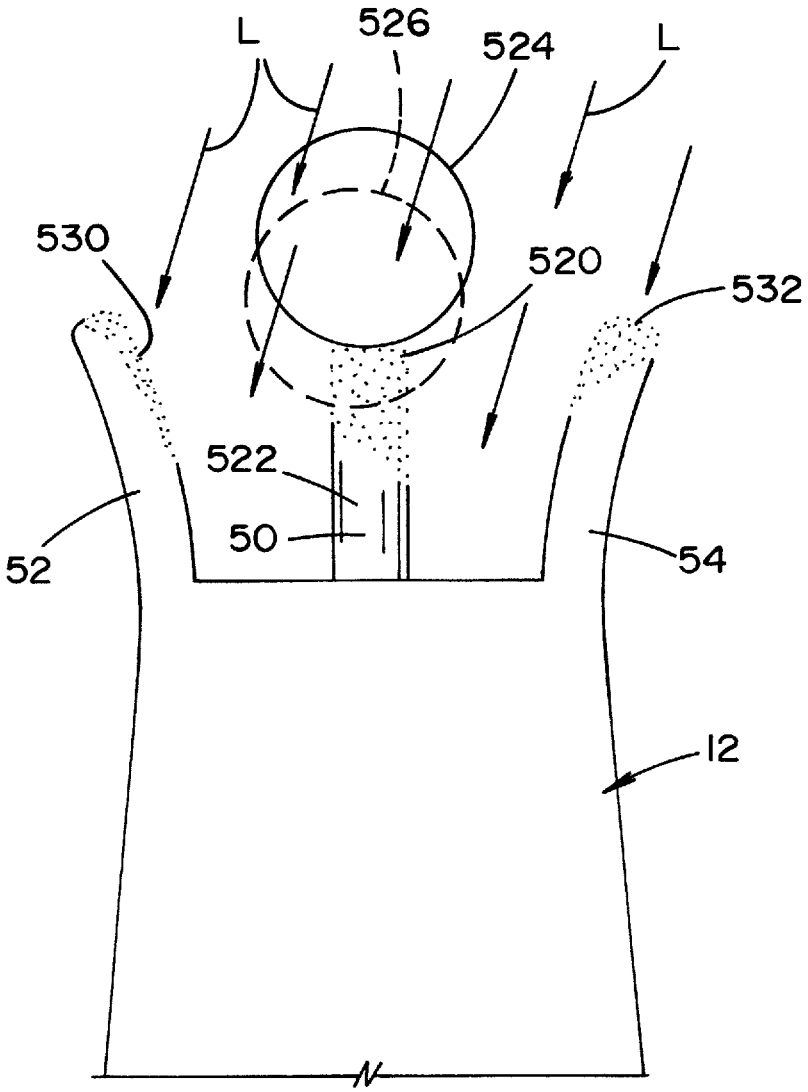
FIG. 24 is a schematic view of an open front sight with sun exposure oriented higher on the right side of the front sight than FIG. 23.
Figure 25:
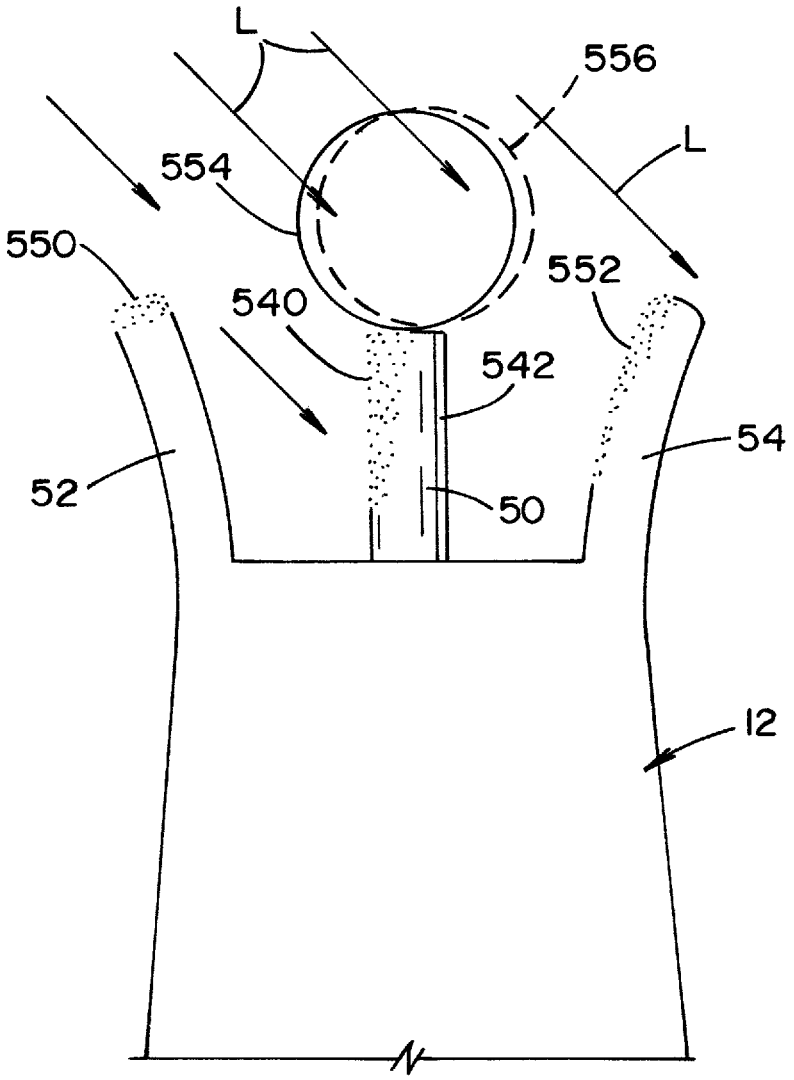
FIG. 25 is a schematic view of an open front sight with sun exposure oriented on the left side of the front sight; and, FIG. 26 is a rear view look through the rear sight of a rifle and at the front sight with a sight enhancer according to certain aspects of the present invention.

With reference to FIGS. 23-25, shown is how the invention of this application prevents sunlight distortion wherein it takes sunlight out of the equation. This can be used when zeroing the sights of a firearm or anytime it is used. Once the firearm is zeroed, the zeroing is maintained. Moreover, these figures show how the sight enhancer of this application takes the open area above the sight out of sighting thereby making target acquisition quicker. Further, in that the sight enhancer is selectively securable to the front sight, it allows for quick front sight adjustment to quickly zero the sights of the firearm while still preventing sunlight distortions.

With particular reference to FIG. 23, shown is the sunlight distortion caused by the sunlight L being positioned to the right of the open sight. These figures show front sight 12 having front sight post 50, left side blade 52 and right side blade 54. When the sun is to the right of the sight, wherein the sunlight L engages the right of the sight, the sunlight distortion is shown by the stippling in the drawings wherein the stippling shows a glare that distorts the edges of the front sight and prevents portions of the front sight components from being visible. In this respect, sunlight distortion is caused by sunlight L brightening a right portion 500 of blade 50 making right portion 500 a non-visible portion of the sight. A left portion 502 of blade 50 will be in shade and; therefore, will be a visible portion of blade 50. Similarly, a top portion 510 of right blade 54 will be brightened causing it to be a non-visible portion of the front sight. Similarly, an inner top portion 512 of left blade 52 will also be a non-visible portion of the front sight. Solid circle 514 is the true sight line or focal point to the target for the front sight and dashed circle 516 is the sight line the shooter will aim at based on the sunlight distortion. Thus, the sunlight distortion in this example will cause the shot to be wide right.

With particular reference to FIG. 24, shown is the sunlight distortion caused by the sunlight L being positioned above the open sight. This figure again show front sight 12 having front sight post 50, left side blade 52 and right side blade 54. When the sun is above the sight, the sunlight L engages a top portion 520 of blade 50 making it a non-visible portion of the sight. A bottom portion 522 of blade 50 will be in shade and; therefore, will be a visible portion of blade 50. Similarly, an inner top portion 530 of left blade 52 will be brightened causing it to be a non-visible portion of the front sight. In addition, an upper and inner top portion 532 of right blade 54 will be a non-visible portion of the front sight. Solid circle 524 is the true sight line or focal point to the target for the front sight and dashed circle 526 is the sight line the shooter will aim at based on the sunlight distortion. Thus, the sunlight distortion in this example will cause the shot to be high and to the right.

With particular reference to FIG. 25, shown is the sunlight distortion caused by the sunlight L being positioned to the left of the open sight. This figure also show front sight 12 having front sight post 50, left side blade 52 and right side blade 54. When the sun is to the left of the sight and the sunlight L engages the left of the sight. In this example, sunlight distortion is caused by the sunlight L brightening a left portion 540 of blade 50 making it a non-visible portion of the sight. A right portion 542 of blade 50 will be in shade and; therefore, will be a visible portion of blade 50. Similarly, a top inner portion 550 of left blade 52 will be brightened causing it to be a non-visible portion of the front sight. Similarly, an inner top portion 552 of right blade 54 will be a non-visible portion of the front sight. Solid circle 554 is the true sight line or focal point to the target for the front sight and dashed circle 556 is the sight line the shooter will aim at based on the sunlight distortion. Thus, the sunlight distortion in this example will cause the shot to be wide left.

FIGS. 23-25 show a typical day period for sunlight distortion wherein in the morning, the sunlight is on one side of the sight, such as on the right side of the sight as is shown in FIG. 23. During mid-day, the sun is above the target as is illustrated in FIG. 24. Then, in the afternoon, the sunlight moves to the other side of the sight, as is shown in FIG. 25. However, this assumes that the angle of the shot remains the same during the entire day, which is the case for a shooting range, but not in real world tactical situations encountered by the police and military personnel. These figures show how sunlight distortion can effect sighting accuracy at both different times of the day and for different shooting angles relative to the sun.

With reference to FIG. 26, sight enhancer 10, 200, 300, 400 prevents sunlight distortion caused by the sunlight L no matter what time of day and no matter the sight line. Sun shade 40, 240, 340, 440 blocks sunlight L wherein true sight line or focal point to the target 514, 524, 554 are in alignment with front sight post 50 and blades 52 and 54.

Moreover, it has also been found that sight enhancer 10, 200, 300, 400 also creates quicker target acquisition. As can be appreciated, the speed as to which a target can be acquired can save the lives of our military personnel and police officers. In a traditional open front sight, there is a wide open area above the sight that slows target acquisition in that the user of the sight must align the target in this open area. This coupled with the sunlight distortion discussed above, slows target acquisition. The figures of this application show how the invention of this application both prevents sunlight distortion and reduces the open area above the front sight. This has been found to both eliminate misalignment of the front sight due to sunlight distortion and to improve target acquisition speeds. Moreover, this figure shows a sight enhancer in relation to a rear sight wherein the sight enhancer forms an overlapping circle with a portion of the circular rear sight. When the front and rear sights are properly aligned, they will form overlapping circles between openings 72, 272. 372 and 472, and rear sight opening 26. If the front and rear sights are not lined up, the shooter will see noticeable shadowing along with the sights not being symmetrical.

The invention of this application has been found to improve the sight performance relating to the open sight systems used by our military and police personnel in many ways. Many of these improvements have been described above, but the benefits of the invention have also been found to be ever expanding. While the invention primarily relates to eliminating sunlight distortion in the open front sight, it has been found to have yet other benefits. One such benefit that has been found is that it also helps recruits who are new to shooting. Beyond the benefits described above, it helps these new shooters by forcing them to use both the front and rear sights when aiming.

While considerable emphasis has been placed on the preferred embodiments of the invention illustrated and described herein, it will be appreciated that other embodiments, and equivalences thereof, can be made and that many changes can be made in the preferred embodiments without departing from the principles of the invention. Furthermore, the embodiments described above can be combined to form yet other embodiments of the invention of this application. Accordingly, it is to be distinctly understood that the foregoing descriptive matter is to be interpreted merely as illustrative of the invention and not as a limitation.

It is claimed:

1. A sight enhancer for an open front sight of a firearm, the sight enhancer comprising a body wherein the body is selectively securable directly to an associated open front sight of an associated firearm wherein the sight enhancer is operable to be selectively installed and removed from the associated open front sight to allow for an elevation adjustment of the associated open front sight, the body having a front and a rear wherein the rear faces an associated rear sight of the associated firearm, the body further including a sun shade that extends at least partially about an associated front sight post of the associated open front sight, the sun shade having a top sun shade portion, a first side sun shade portion and a second side sun shade portion that is opposite of the first side sun shade portion, the sight enhancer further includes one or more securing arrangements for the selective secureability directly to the associated open front sight; the body further comprising a vertically extending panel that includes an enhancer opening extending therethrough, the enhancer opening having an inward opening shape that extends around an opening axis, the enhancer opening extending completely around the opening axis.

2. The sight enhancer according to claim 1, wherein the one or more securing arrangements secures the vertically extending panel to the associated open front sight and wherein the sight enhancer is held in place by the vertically extending panel, the sun shade extending from the vertically extending panel.

3. The sight enhancer according to claim 2, wherein the one or more securing arrangements includes at least one flange extending from the vertically extending panel.

4. The sight enhancer according to claim 1, wherein the one or more securing arrangements includes a securing strap and one or more tie apertures in the vertically extending panel that are shaped to receive the securing strap.

5. The sight enhancer according to claim 1, wherein the sun shade extends perpendicularly from the vertically extending panel and is spaced from the enhancer opening.

6. The sight enhancer according to claim 5, wherein the inward opening shape is round.

7. The sight enhancer according to claim 1, wherein the vertically extending panel is joined directly to the sun shade and is a unified panel with the enhancer opening extending through the unified panel and the enhancer opening being spaced from the sun shade, the one or more securing arrangements for the selective secureability directly to the associated open front sight selectively securing the vertically extending panel directly to the front sight and the sun shade extending from the vertically extending panel.

8. The sight enhancer according to claim 7, wherein the vertically extending panel is perpendicular to a sight line formed by the associated front and rear sights.

9. The sight enhancer according to claim 1, wherein the vertically extending panel is perpendicular to a sight line formed by the associated front and rear sights.

10. The sight enhancer according to claim 9, wherein the opening axis is coaxial with the sight line formed by the associated front and rear sights.

11. The sight enhancer according to claim 1, wherein the one or more securing arrangements includes a securing strap and includes at least one of a tie opening and a tie slot in the vertically extending panel operable to hold the securing strap relative to the vertically extending panel, the securing strap extending about at least a portion of the associated front sight and the sight enhancer to selectively secure the vertically extending panel of the sight enhancer against the associated front sight.

12. The sight enhancer according to claim 1, wherein the one or more securing arrangements includes a securing strap, the securing strap operable to urge the vertically extending panel against the associated front sight to selectively secure the vertically extending panel against the associated front sight, the sun shade being spaced from the front sight.

13. The sight enhancer according to claim 1, wherein the one or more securing arrangements urges a panel surface of the vertically extending panel against the associated front sight to selectively secure the vertically extending panel of the sight enhancer against the associated front sight, the sight enhancer being spaced from an associated barrel of the associated firearm.

14. A sight enhancer for an open front sight of a firearm, the sight enhancer comprising a body wherein the body is selectively securable relative to an associated open front sight of an associated firearm wherein the sight enhancer can be selectively installed and removed from the associated open front sight to allow for an elevation adjustment of the associated open front sight, the body having a front and a rear wherein the rear faces an associated rear sight of the associated firearm, the body further including a sun shade that extends at least partially about an associated front sight post of the associated open front sight, the sun shade having a top sun shade portion, a first side sun shade portion and a second side sun shade portion that is opposite of the first side sun shade portion, the sight enhancer further includes one or more securing arrangements for the selective secureability to the associated open front sight, wherein the one or more securing arrangements includes a magnet.

15. A sight enhancer for an open front sight of a firearm, the sight enhancer comprising a body wherein the body is selectively securable relative to an associated open front sight of an associated firearm wherein the sight enhancer can be selectively installed and removed from the associated open front sight to allow for an elevation adjustment of the associated open front sight, the body having a front and a rear wherein the rear faces an associated rear sight of the associated firearm, the body further including a sun shade that extends at least partially about an associated front sight post of the associated open front sight, the sun shade having a top sun shade portion, a first side sun shade portion and a second side sun shade portion that is opposite of the first side shade portion, the sight enhancer further includes one or more securing arrangements for the selective secureability to the associated open front sight, wherein the enhancer opening includes one or more enhancing rings.

16. The sight enhancer according to claim 15, wherein the body is a first color and the one or more enhancing rings is a second color.

17. The sight enhancer according to claim 16, wherein the first color is black and the second color is at least one of red, orange, yellow, white, blue and green.

18. The sight enhancer according to claim 16, wherein the one or more enhancing rings include fiber optics.

19. The sight enhancer according to claim 16, wherein the one or more enhancing rings is formed from a transparent material.

20. The sight enhancer according to claim 15, wherein the one or more enhancing rings is a plurality of enhancing rings wherein each of the plurality of enhancing rings is selectively securable relative to the body, each of the plurality of enhancing rings having an inner ring diameter that forms the inner opening diameter, at least one of said each enhancing ring having a different inner ring diameter.

21. The sight enhancer according to claim 15, wherein the one or more enhancing rings is selectively securable relative to the body.

22. A sight enhancer for an open front sight of a firearm, the sight enhancer comprising a body wherein the body is selectively securable relative to an associated open front sight of an associated firearm wherein the sight enhancer can be selectively installed and removed from the associated open front sight to allow for an elevation adjustment of the associated open front sight, the body having a front and a rear wherein the rear faces an associated rear sight of the associated firearm, the body further including a sun shade that extends at least partially about an associated front sight post of the associated open front sight, the sun shade having a top sun shade portion, a first side sun shade portion and a second side sun shade portion that is opposite of the first side sun shade portion, the sight enhancer further includes one or more securing arrangements for the selective secureability to the associated open front sight, wherein the body includes a vertically extending front panel and the one or more securing arrangements includes a pair of rearwardly extending flanges extending from the vertically front extending panel, the sight enhancer further including a pair of opposing slots in the front panel that are shaped to receive securing strap wherein the one or more securing arrangements includes the securing strap.

23. A method of sighting a firearm without the effect of sunlight distortion, said method including the following steps:

providing a sight enhancer according to claim 1;

temporality securing the sight enhancer relative to an open front sight of a firearm;

firing a first group of bullets at a target;

determining any adjustment that is needed to the front sight based on the first group;

removing the sight enhancer;

making the needed adjustment;

re-securing the sight enhancer relative to an open front sight of a firearm;

firing a second group of bullets at a target.

* * * * *